US005490606A

United States Patent [19]

Lombardo

[11] Patent Number: 5,490,606

[45] Date of Patent: Feb. 13, 1996

[54] REFUSE CONTAINER FOR SEGREGATING REFUSE AND TRUCK ATTACHMENT FOR USE IN CONNECTION THEREWITH

[76] Inventor: Santo J. Lombardo, 141 Mountain Rd., Glastonbury, Conn. 06033

[21] Appl. No.: 171,902

[22] Filed: Dec. 22, 1993

[51] Int. Cl.[6] ..... B30B 1/18

[52] U.S. Cl. ..... 220/324; 220/908; 292/240; 294/68.26

[58] Field of Search ..... 220/751, 908, 220/315, 324; 292/230, 238, 240; 294/68.26

[56] References Cited

U.S. PATENT DOCUMENTS

| | | | |
|---|---|---|---|
| 961,780 | 6/1910 | Lauzon . | |
| 1,226,511 | 5/1917 | Harper . | |
| 1,880,250 | 1/1931 | Hopkins . | |
| 2,702,142 | 2/1955 | Jones | 220/34 |
| 3,315,828 | 4/1967 | Dubo | 220/908 X |
| 3,893,722 | 7/1975 | Galbreath et al. | 292/240 X |
| 4,057,020 | 11/1977 | Halliar | 105/377 |
| 4,088,071 | 5/1978 | Cruse et al. | 294/68.26 X |
| 4,182,530 | 1/1980 | Hodge | 220/908 X |
| 4,456,141 | 6/1984 | Pamment | 220/908 X |
| 5,035,563 | 7/1991 | Mezey | 414/409 |
| 5,042,856 | 8/1991 | Goodman | 220/315 X |
| 5,098,250 | 3/1992 | Carson | 414/411 |
| 5,103,994 | 4/1992 | Doxey | 220/324 |
| 5,201,434 | 4/1993 | De Vivo | 220/315 |

*Primary Examiner*—Steven M. Pollard

[57] ABSTRACT

A refuse container assembly for segregating refuse into two separately collectable volumes includes a refuse container with a divider wall extending from front to rear wall to divide the interior into two compartments. Separate lids for the compartments are hingedly connected to the rear wall and have a locking pin extending outwardly of the adjacent side wall. Locking members are disposed on the outer surface of each of the side walls and are movable between a position engaging the locking pin and a releasing position. An actuator on the forward end of a refuse collection truck bears upon and moves one locking member from one of the positions to the other of the positions, thereby allowing one of the lids to be opened to effect discharge of the contents of its compartment.

20 Claims, 8 Drawing Sheets

FIG. 2
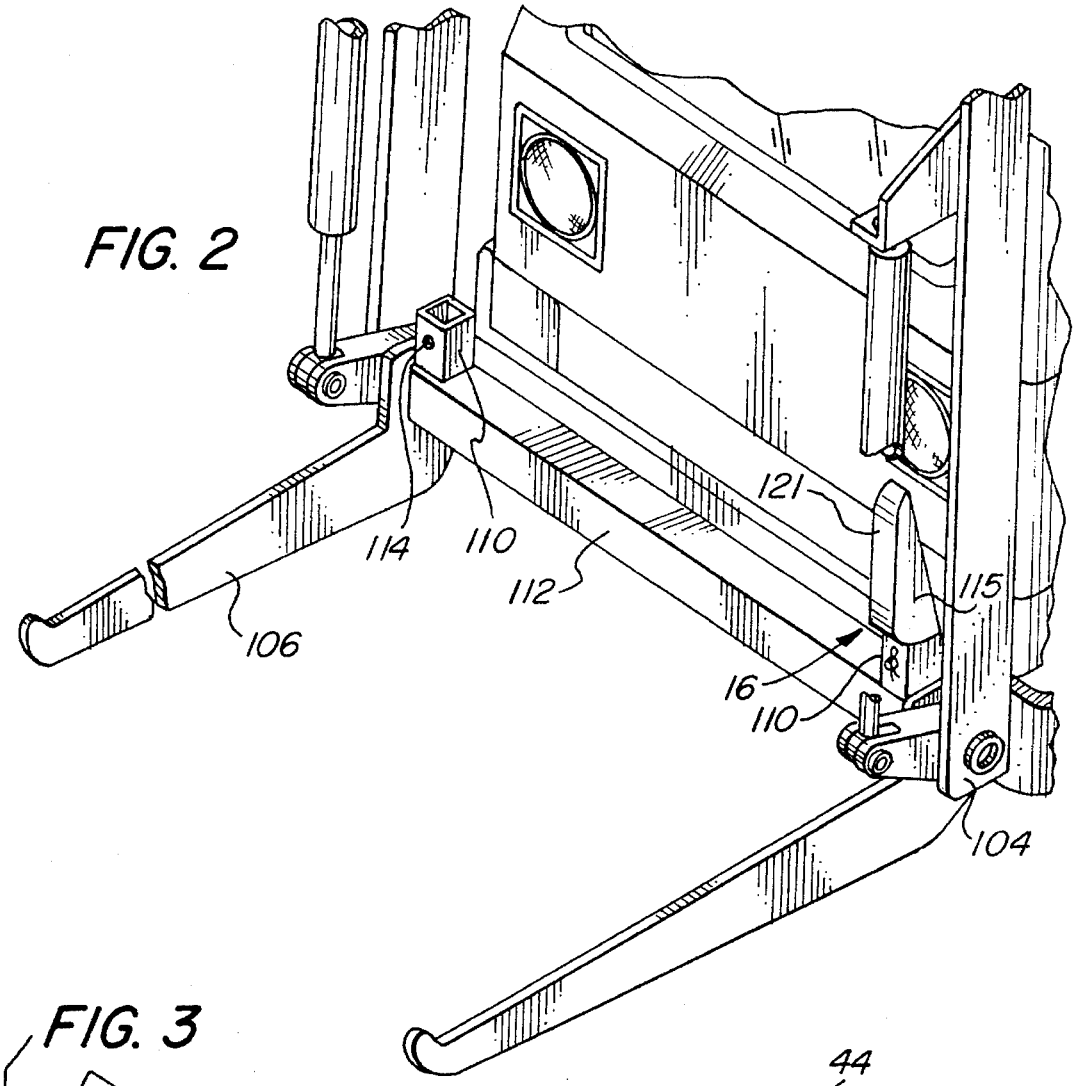
FIG. 3
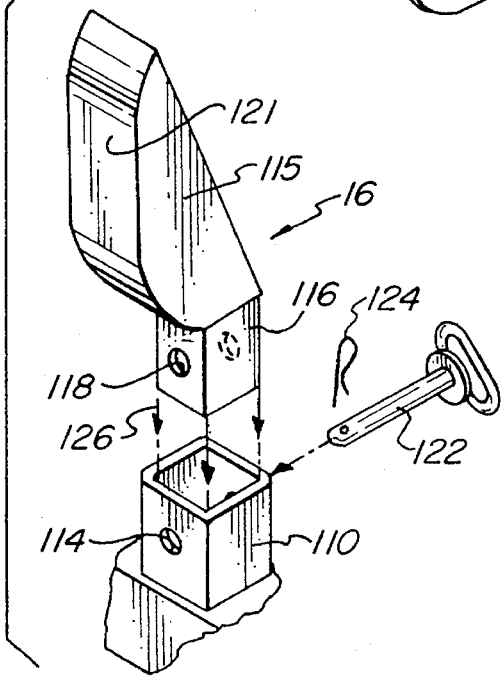
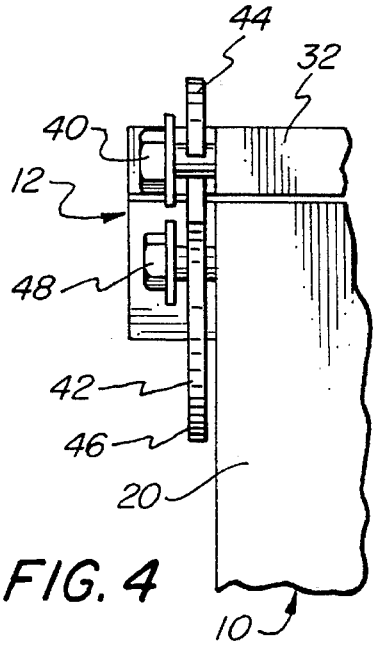
FIG. 4

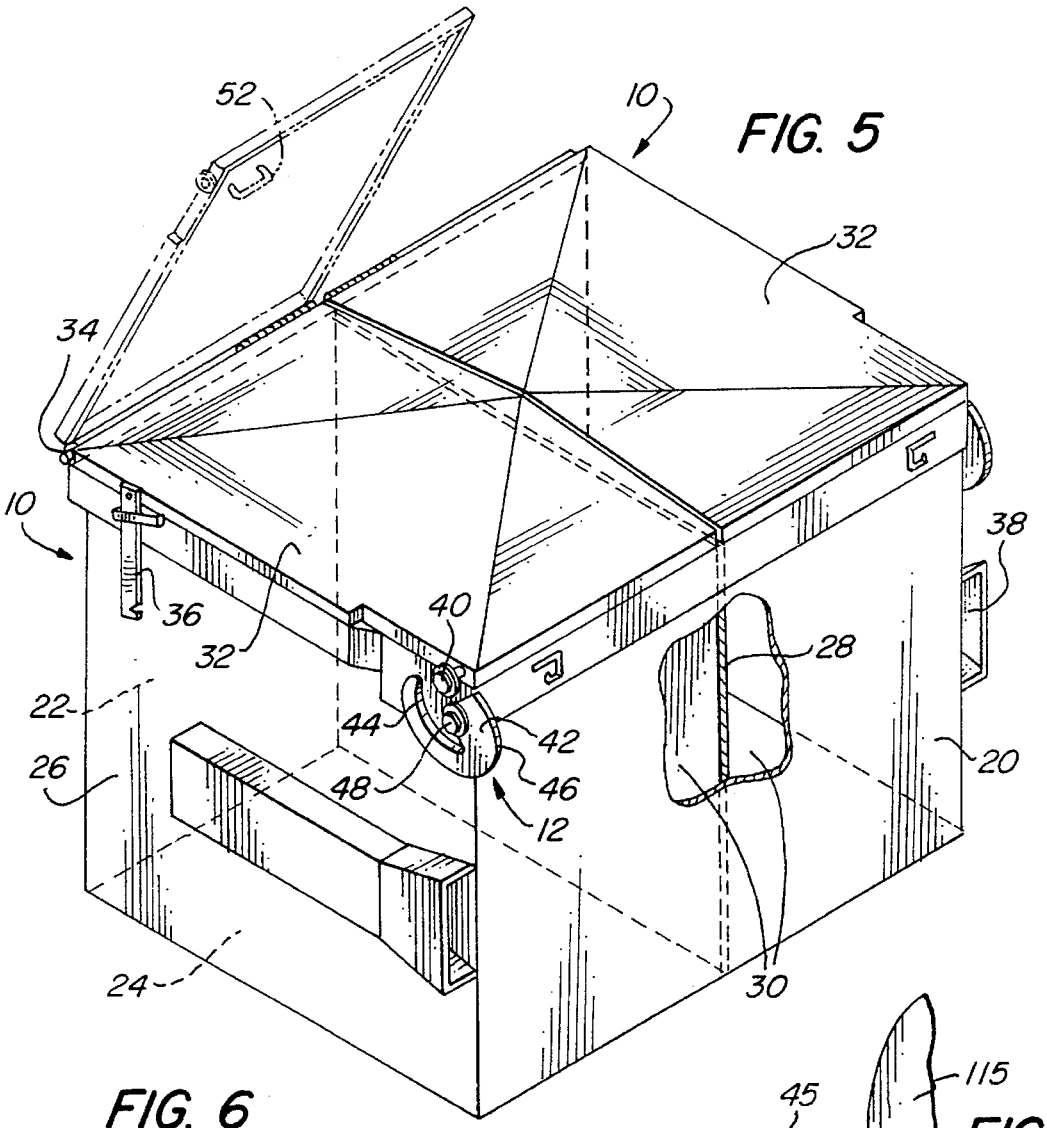
FIG. 5
FIG. 6
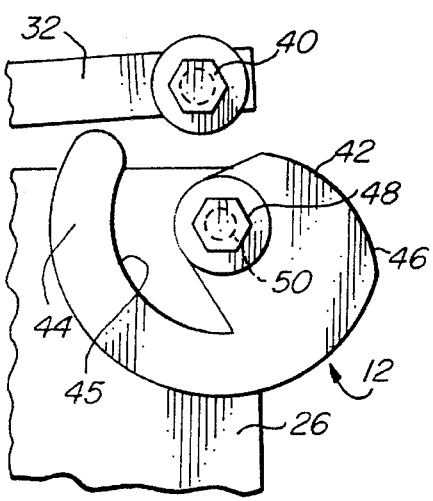
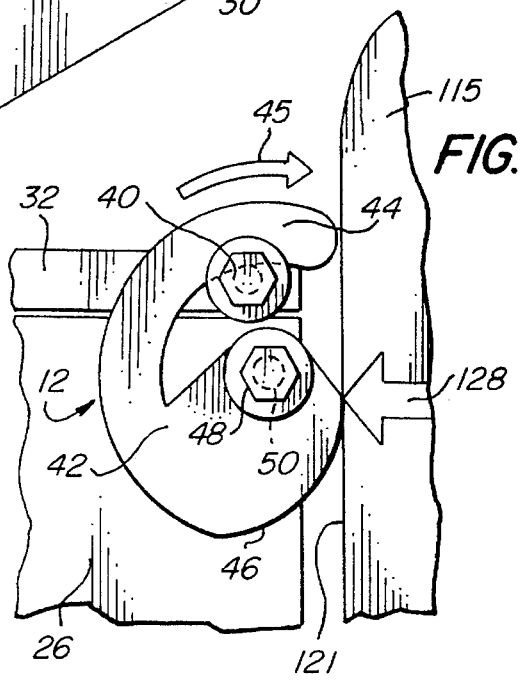
FIG. 7

REFUSE CONTAINER FOR SEGREGATING REFUSE AND TRUCK ATTACHMENT FOR USE IN CONNECTION THEREWITH

BACKGROUND OF THE INVENTION

The present invention relates to containers for the segregation of refuse, and, more particularly, to compartmented refuse containers emptied by collection trucks with plural compartments which may be selectively emptied.

In recent years, there has been great emphasis on recycling numerous types of refuse as a result of the need to limit the amount of material deposited in sanitary land fills and the need to conserve resources by recycling such materials as glass, metals, and plastic. Unfortunately, recycling is labor intensive for the refuse collector, as well as the refuse generator.

To minimize the potential for a third party placing unsegregated materials in the refuse container or intermingling the contents of segregated compartments, it is desirable that the lids of the refuse containers be locked to limit access.

As a result of segregation for refuse for recycling, many owners of apartment units and commercial buildings now employ multiple refuse containers of the type which are picked up by hydraulic lift devices on garbage collection trucks and dumped into the truck. These are separately collected.

Partitioned collection trucks are well known. Typically, refuse that has been separated is manually collected and dumped into the appropriate compartment of the refuse truck. Attempts at automating the process have met with limited success. One such automated system utilizes a partitioned curbside container at the apartment house or business. Pick-up arms on the collection truck are equipped with closure elements that keep the lids of the container shut until the container is lifted, inverted, and positioned over the proper bin of the collection truck. A computer controls the movement of the pick-up arms and further controls the release of the container lids, providing a system that is both complex and expensive. Additionally, lid release does not occur until the full weight of the contents is on the lid, resulting in increased wear and maintenance.

Another system for use with a partitioned collection truck uses a storage container with several compartments, each having its own door. The doors are spring biased shut, and sufficient force on a tab attached to the door causes the door to pivot open. When the storage container is inverted over the truck, elements on the truck provide the opening force to the tabs on the doors. The contents of all of the storage container compartments are simultaneously discharged into the respective compartments on the truck. The difficulty with this system is that precise positioning of the storage container over the truck is required in all three axes of movement. Also, the operator may not detect a problem until it is too late to avoid. As will be appreciated, these systems involve special and expensive truck constructions and/or refuse containers.

It is an object of the present invention to provide a novel compartmented refuse container assembly in which the compartments may be separately discharged and which is simple in design and operative with a high degree of reliability.

It is also an object to provide such a refuse container assembly which may be readily fabricated by relatively simple modification of existing refuse containers and trucks.

Another object is to provide such a container assembly which does not require precise positioning of the container relative to the truck for discharge of the contents.

A further object is to provide such a container assembly which can be readily and relatively economically fabricated.

SUMMARY OF THE INVENTION

It has now been found that the foregoing and related objects may be readily attained in a refuse container assembly which segregates refuse into two separate volumes for separate discharge into collecting trucks. The refuse container assembly has a refuse container with front, rear, bottom and side walls, a divider wall extending therewithin from the front to rear walls to divide the interior of the container into two compartments, and separate lids extending over the compartments. Each of the lids is hingedly connected to the rear wall and has an engageable element thereon extending outwardly of the adjacent side wall. A locking member on the outer surface of each of the side walls has a configuration engageable with the engageable elements on the lids.

The refuse container assembly also has means movably supporting the locking members for movement between a first position disengaged from the engageable element on the lid and a second position wherein the engageable element is engaged thereby to lock the lids in a closed position. Movement means effects movement of one of the locking members between the positions.

Preferably, the engageable element is a lock pin extending from the lid and beyond the side wall, and the movably supporting means is provided by a pivot element on each side wall enabling the locking member to rotate about a pivot axis defined by the pivot element and in a plane substantially parallel to the side wall.

Desirably, the configuration of the locking member provides on one side, spaced from the pivot axis, an arm for engaging the lock pin. The configuration also provides an arcuate surface portion along opposite sides of the locking member. Upon application of force to the arcuate surface, this configuration produces rotation of the locking member from one of the positions to the other of the positions.

Preferably, the movement means comprises an actuating element for attachment to the forward end of an associated refuse collection truck, and it is cooperatively configured to move a locking member from one of the positions to the other of the positions, thereby allowing one of the lids to be opened to effect discharge of the contents of its compartment.

The refuse container assembly desirably includes a latching assembly within the container, and it has latching means movable from first to second positions to engage the lids in the first position and releasably latch them in a closed condition. Means is provided to bias the latching means towards the first position. In this embodiment, the latching assembly is operatively coupled to the locking members, and the application of force effecting movement of one of the locking members from the first position to the second position causes the latching means for the lid to move to the second position. In this position, the lids are unlatched from the latching means and only the lid engaged by the locking member is held against opening.

Preferably, this latching assembly includes a latching shackle on the inside surface of each of the lids adjacent the front end thereof, a latching shaft rotatable about a horizontal axis, and a pair of latching members on the shaft engaging the shackles upon rotation of the shaft. The biasing means acts upon the latching shaft to effect rotation of the latching members to the first position of the latching means.

Desirably, the movably supporting means for the locking members comprises a shaft coupled to the latching shaft and having end portions mounting the locking members for rotation therewith. The latching shaft is a sleeve on and rotatable about a shaft extending through the side walls to provide the movably supporting means for the locking members. There is included a coupling between the sleeve and the shaft to effect rotation of the sleeve to unlatch the lids upon the application of force to effect movement of one of the locking members from the first position to the second position.

In the preferred construction, the front wall of the container is formed with an aperture, and the latching assembly includes a key actuator on the latching shaft. A key is insertable through the aperture to engage the key actuator to effect rotation of the latching shaft to a second position wherein the lids are unlatched.

BRIEF DESCRIPTION OF THE DRAWINGS

FIG. 2 is a fragmentary perspective view of a refuse collection truck and its fork lift assembly, showing the truck mounted actuating assembly of the present invention mounted on the fork lift assembly;

FIG. 3 is an exploded perspective view of the truck mounted actuating assembly and a fragmentary portion of the fork lift assembly;

FIG. 4 is a fragmentary front elevational view of the refuse container showing one of the external locking assemblies;

FIG. 5 is a perspective view of the refuse container with part of the front wall broken away to show internal structure, and with one of the lids shown in phantom line in an open position;

FIG. 6 is a fragmentary side elevational view of the refuse container showing one of the external locking assemblies in the unlocked position;

FIG. 7 is a view similar to FIG. 6, but showing the external locking assembly in the locked position, and also showing a fragmentary portion of the truck mounted actuating member;

DETAILED DESCRIPTION OF THE PREFERRED EMBODIMENT

Figure 1:
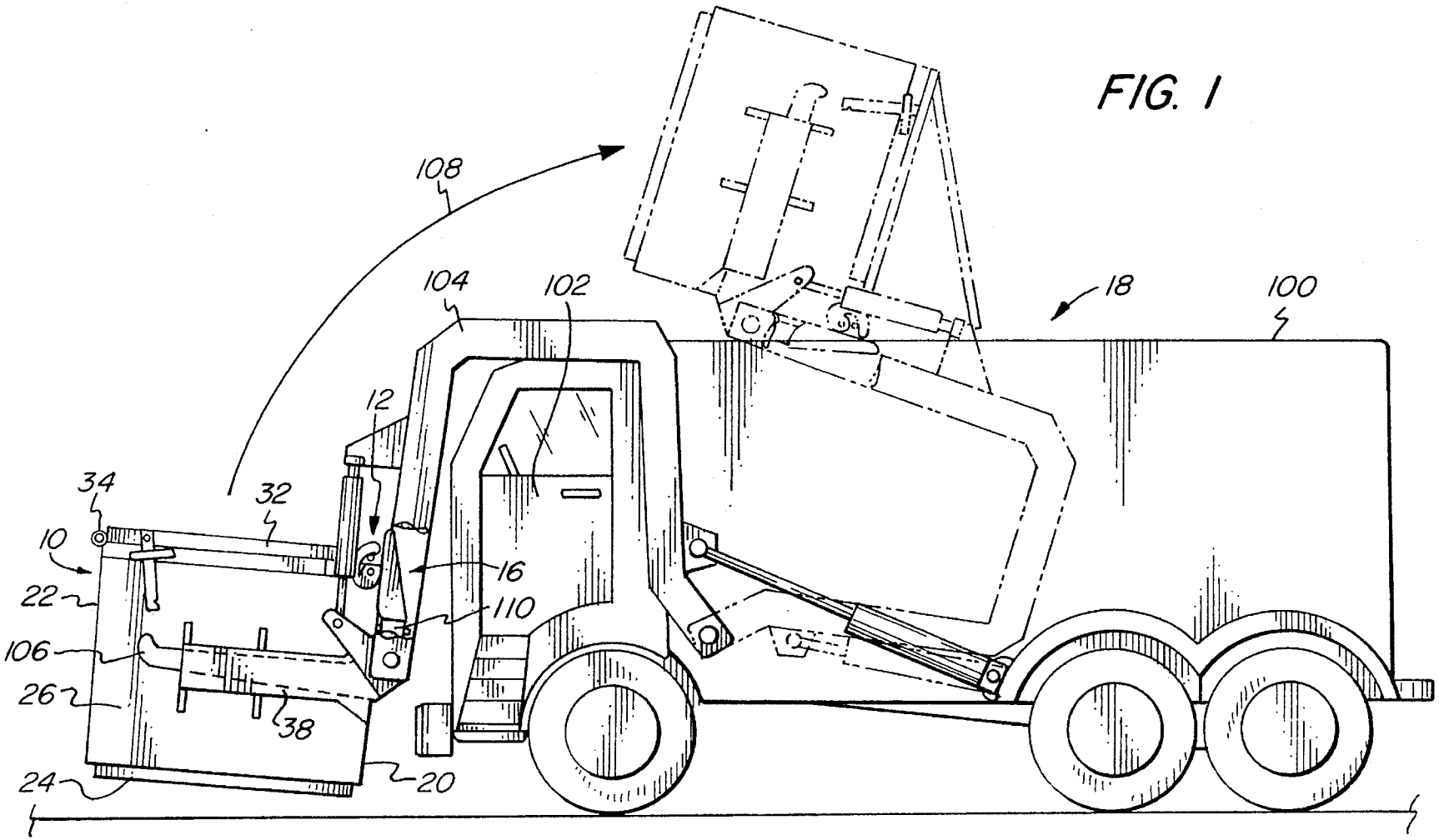
FIG. 1 is a side elevational view of a refuse container embodying the present invention as it is being elevated by a refuse collection truck, and showing in phantom line the position of the fork lift assembly and the refuse container when the container is discharging its contents.

Turning first to FIG. 1, therein illustrated is a refuse container assembly embodying the present invention and which includes a refuse container generally designated by the numeral 10, a pair of external locking assemblies generally designated by the numeral 12, and an actuating assembly generally designated by the numeral 16 mounted upon a refuse collection truck generally designated by the numeral 18. The refuse container 10 has horizontally extending sleeves 38 on its sides which receive the forks 106 of the truck lift apparatus to enable the container to be lifted into the position shown in phantom line to dump its contents into the refuse compartment 100.

Figure 8:
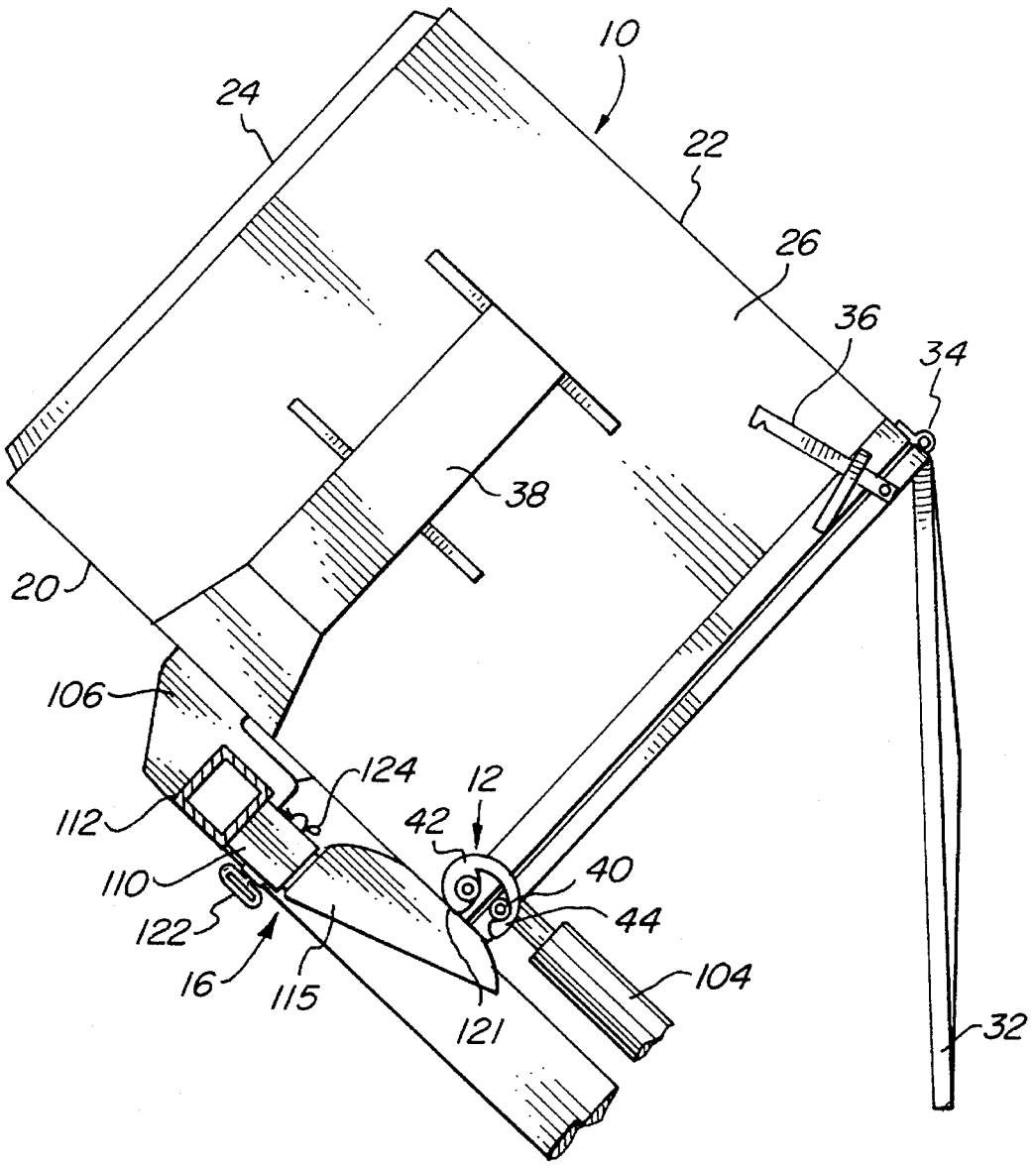
FIG. 8 is a side elevational view of the refuse container hoisted into a contents discharging position, and also showing fragmentarily the fork lift assembly and actuating member.

Referring in detail to FIGS. 5 and 8, the container 10 has a front wall 20, rear wall 22, bottom wall 24, and side walls 26. A divider wall 28 extends between the front wall 20 and rear wall 22 to divide the container 10 into two compartments 30. A separate lid 32 extends over each of the compartments 30 and is mounted to the rear wall 22 by hinges 34. A brace 36 is pivoted on each of the side walls 26 to enable the lids 32 to be propped open. The side walls 26 have the fork sleeves 38 mounted upon them.

As seen in FIGS. 4–7, each external locking assembly 12 has a lock pin 40 on the outer side of the lid 32 adjacent the front wall 20, and it extends horizontally outwardly of the side wall 26 of the container 10. Adjacent each side wall 26 is a locking member 42 which is rotatably supported on a pivot shaft 48 provided by a bolt which extends through the aperture 50 therein to provide the pivot axis therefor. A portion of the periphery of the locking member 42 provides an arcuate hook or engaging arm 44 to grip the lock pin 40 which slides in the channel 45 provided thereby. The locking member 42 has an arcuate peripheral edge 46 spaced to the opposite side of the pivot axis from the arm 44 and it is configured so that force horizontally applied thereagainst will cause rotation of the locking member 42 in the direction of the arrow 45, from a position wherein the engaging arm 44 is spaced from the lock pin 40 to a position wherein the engaging arm 44 engages the pin 40 in the channel 45. As will be appreciated, the rotation of the locking member 42 is in a plane substantially parallel to that of the side wall 26.

Referring next to FIGS. 9–13, therein illustrated is a preferred embodiment of the present invention in which there is included an internal latching assembly 14 which is positioned substantially within the refuse container 10 and which releasably latches the lids 32 in a closed position. The internal latching assembly 14 includes depending latching shackles 52 mounted on the inside surface of the lids 32 adjacent their front end, and a pair of hollow latching shaft 54 which is concentrically mounted on the through shaft 56 which extends parallel to the front wall 20 of the container 10. The sleeve or latching shaft 54 is rotatably supported in a central bearing plates 58 and side bearing plates 60 adjacent the side walls 26. The central bearing plates 58 and the side bearing plates 60 are supported on an L-shaped support bracket 62 which is secured to the side walls 26 and front wall 20. On the latching shaft 54 are latching members 64 having an arcuate portion to engage the shackles 52 on the lids 32.

A pair of torsion springs 66 is concentrically mounted on the sleeve or latching shaft 54 on each side of the central bearing plates 58. At one end, the springs 66 are engaged with a pin 70 on the latching shaft 54, and at the other end to a pin 68 on a central bearing plate 58. The springs 66 are tensioned to bias the latching shaft 54 so that is rotates about its axis in the direction shown by the arrow 71 in FIG. 9. To prevent axial movement of the latching shaft 54, latching shaft retainer rings 72 are mounted on the latching shaft 54 adjacent to and outwardly of the side bearing plates 60.

The internal latching assembly 14 provides at the ends of the through shaft 56 internally threaded portions 74 which seat the bolts 48 to mount the locking members 42 thereon. Adjacent to and inwardly from the side walls 26, retainers 78 are mounted on the locking shaft 74 to limit axial movement thereof. As seen, the end portions of the through shaft 74 extend through the side walls 26 and not only serve as an outwardly extending portion of the internal latching assembly 14 but also mounts thereon the movable portion of the external locking assembly 12.

On each end portion of the locking shaft 74 adjacent the ends of the latching shaft or sleeve 54, is an L-shaped latching shaft actuator 80 which is dimensioned and configured to provide a tab 81 which will abut the tab 82 on the end of the latching shaft 54. Upon rotation of the locking shaft 74 in the direction opposite that indicated by the arrow 71, the tab 81 abuts the tab 82 causing rotation of the latching shaft 54 to pivot the latching members 64 away from the shackles 52, thereby releasing the lids 32.

The latching shaft 54 also has stop tabs 84 on its surface adjacent the side bearing plates 60. Upon rotation of the latching shaft 54 in its biased direction indicated by the arrow 71, each stop tab 84 engages a stop 86 on the inside surface of the side bearing plate 60 to limit rotation of the latching shaft 54 in the event that the latching shaft 54 is rotated without the shackles 52 being in a position to be engaged by the latching members 64.

On the periphery of the latching shaft 54 is a radially extending generally J-shaped key actuator 88 providing a channel 89 between the legs thereof. In the front wall 20 of the refuse container 10 in alignment with the key actuator 88 is an aperture 90 which contains a horizontal portion 91 aligned with the channel 89 of the key actuator 88, a vertical portion 93, and a horizontal portion 92.

To operate the internal latching assembly 14 to release the lids 32, a key 94 is inserted through the aperture 90 to engage in the channel 89 of the key actuator 88. The key 94 has a head 95 which is configured to pass through the horizontal portion 91 of the aperture 98 and engage in the channel 89, and it has a shaft at one side of the head. The shaft 98 of the key 94 extends in the vertical portion 93 of the aperture 90. A user applies downward pressure on the handle 96 of the key 94 to move the shaft 98 downwardly in the vertical portion 93 of the aperture 90, in the direction of the arrow 97 in FIG. 12 and then moves the shaft 98 laterally into horizontal portion 92 of the aperture 90. In this manner, the latching shaft 54 is rotated against the biasing pressure of the spring 66 and the latching members 64 are moved in the direction of the arrow 99 in FIG. 12 to release the latching shackles 52, thus allowing opening of the lids 32.

Referring next to FIGS. 2–4, it will be noted that the forks 106 are connected by transverse bar 112 upon which is mounted the actuating assembly 16. Fastened to the transverse bar 112 at each end is a vertically disposed mounting receptacle 110 which provides a recess of square cross section. Seated in the recess of a receptacle 110 is the base 116 of an actuating member 115 which has a generally vertical contact surface 121.

The actuating element 115 is mounted in the mounting receptacle 110 by inserting the base 116 thereinto and inserting a fastener 122 through apertures 114, 118 in the receptacle 110 and base 116 and securing it with the spring locking pin 124. The actuating element 115 can be positioned in either receptacle 110 depending upon the locking member 42 to be engaged.

Figure 9:
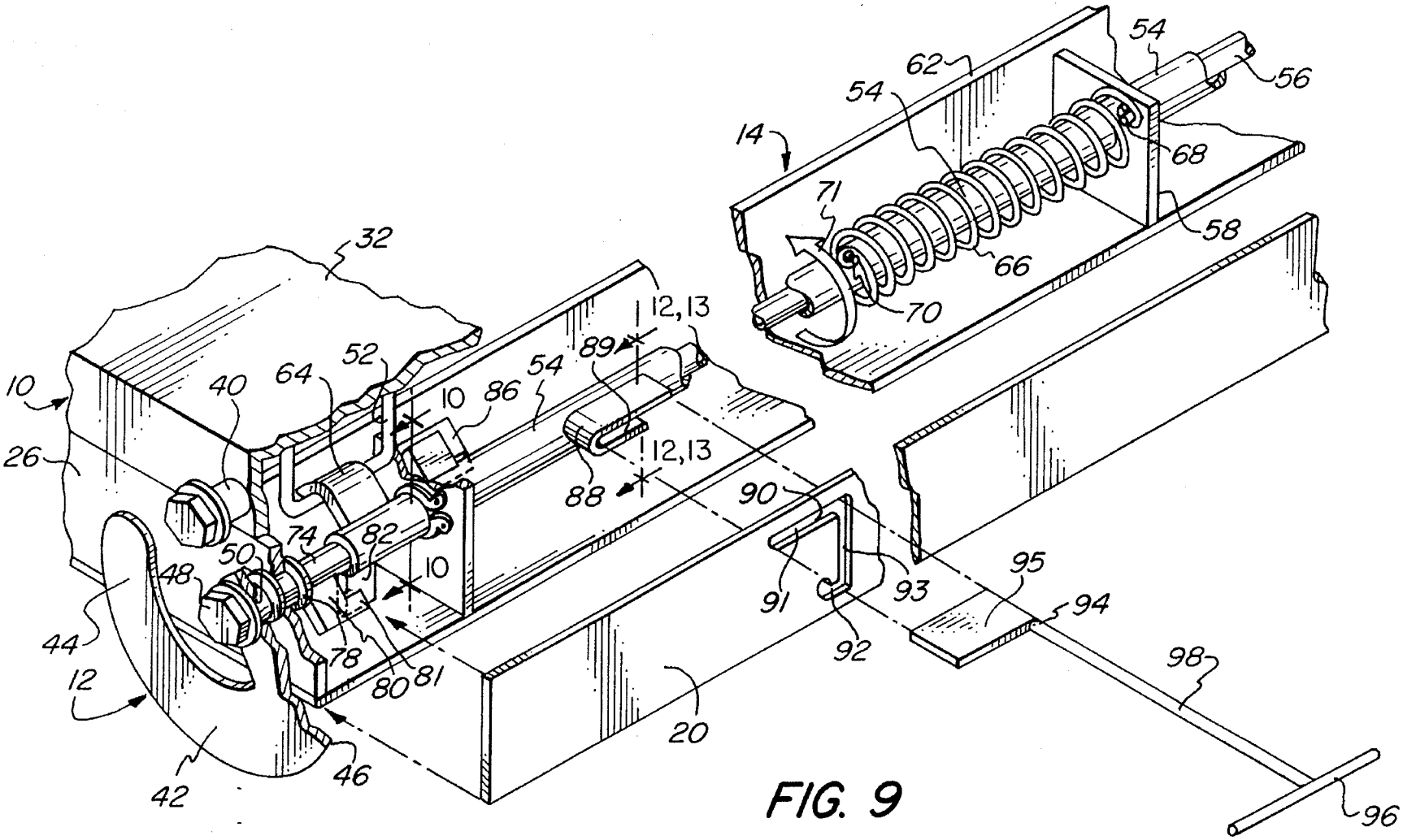
FIG. 9 is a fragmentary perspective view of the preferred embodiment of the container with portions of the container broken away and exploded to show the internal latching assembly.
Figure 11:
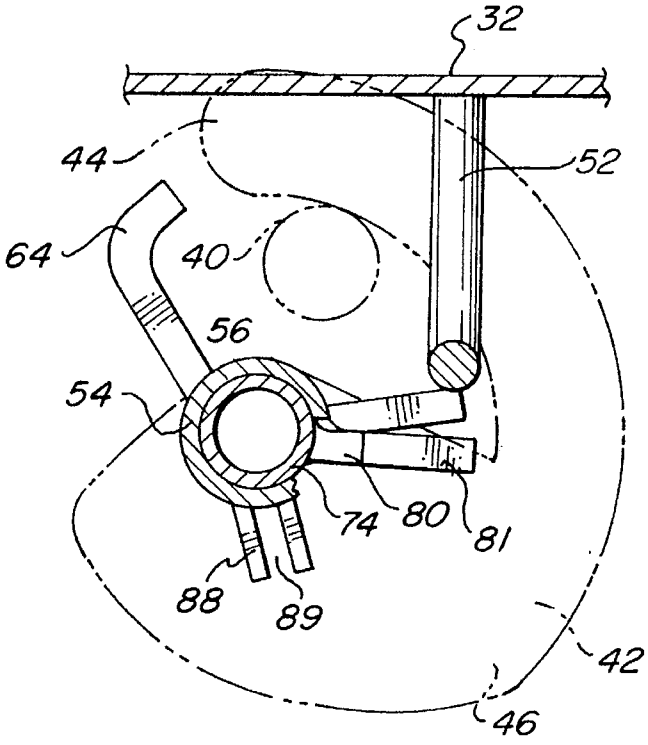
FIG. 11 is a view similar to FIG. 10 showing the latching member rotated away from the latching shackle of the lid and with the locking member rotated into locking engagement with the locking pin.
Figure 10:
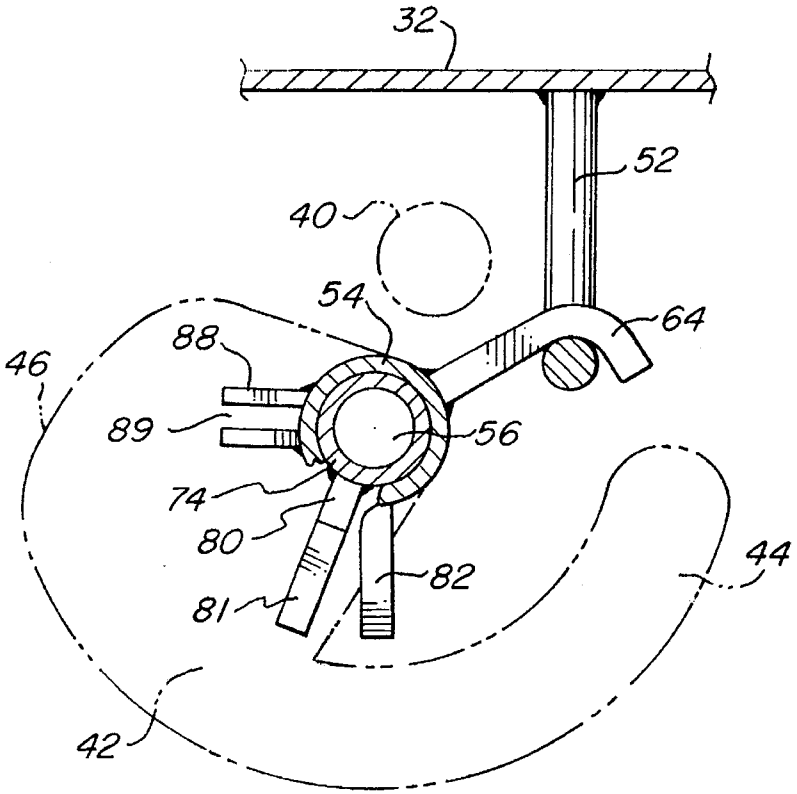
FIG. 10 is a fragmentary sectional view of the container along the line 10—10 of FIG. 9 showing a latching member engaging a latching shackle on the lid and showing the external locking member and locking pin in phantom line.
Figure 12:
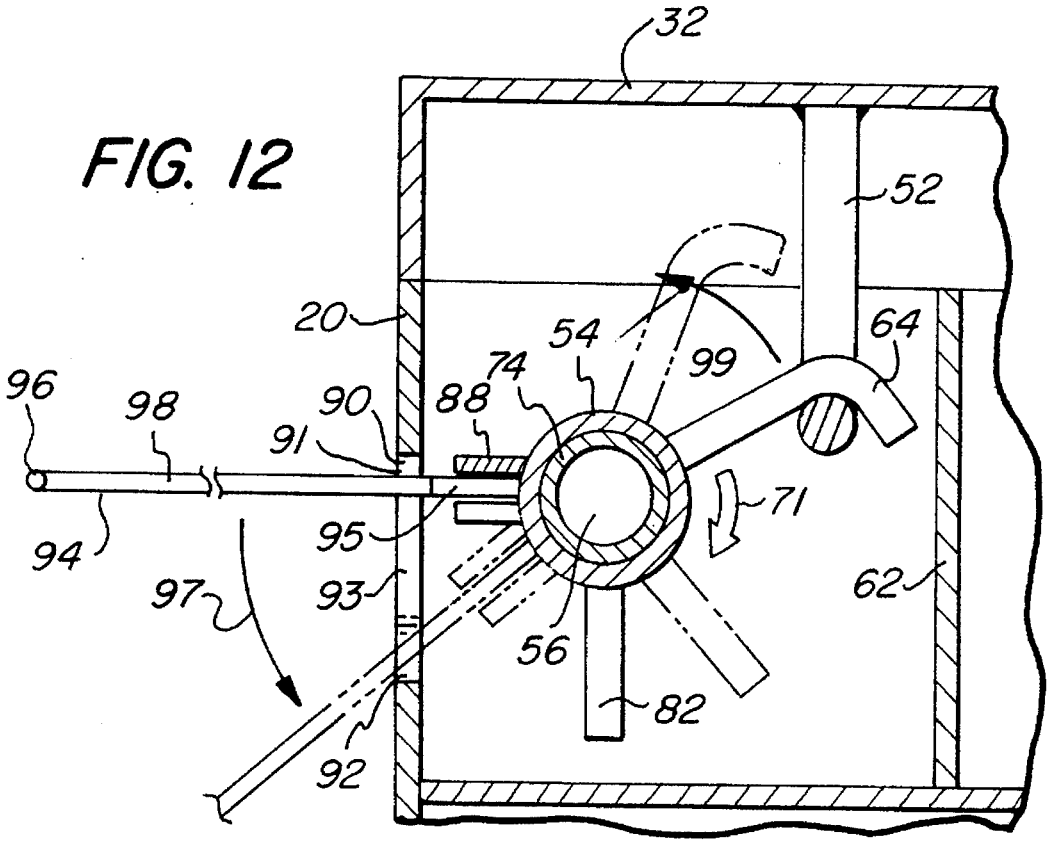
FIG. 12 is a fragmentary sectional view of the container along the line 12—12 of FIG. 9 showing a key engaged in the key actuator and the latching member engaging the latching shackle, with the parts rotated into a releasing position.
Figure 13:
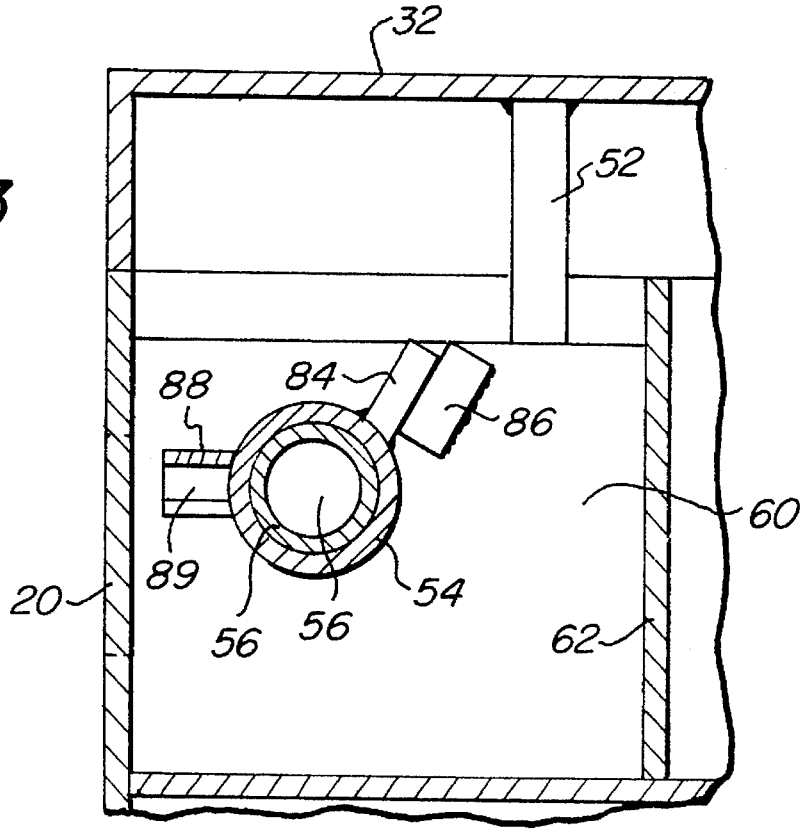
FIG. 13 is a fragmentary sectional view of the container along the line 13—13 of FIG. 9 showing a tab on the latching shaft abutting a stop.

In operation, the components of the refuse container assembly are normally in a condition in which the torsion spring 66 biases the latching shaft 54 to rotate it in the direction of the arrow 71 seen in FIG. 9 and move the latching members 64 to engage the latching shackles 52 to lock the lids 32 in a closed position. When the latching shaft 54 is in this biased position, the stop tabs 84 abut the stops 86, and the latching shaft tabs 82 abut the latching shaft actuators 80 on the locking shaft 74. The key actuator 88 on the latching shaft 54 is aligned with the horizontal portion 91 of the aperture 90. In this position, the refuse container lids 32 are latched shut against intrusion, and the container 10 is used for refuse collection.

The collection procedure begins with the refuse collection truck 18 driving towards the front wall 20 of the refuse container 10. As the truck 18 advances, the forks 106 of the fork lift assembly 104 of the truck 18 slide into the fork sleeves 38, and the contact surface 121 of the actuating member 115 moves in the direction of arrow 128 in FIG. 7 to abut and bear against the arcuate surface 46 of one of the locking members 42. This causes rotation of the locking member 42 and engagement of the lock pin 40 by the arm 44, thereby locking the corresponding lid.

Rotation of the locking member 42 also causes rotation of the locking shaft 74 and pushes the tab 81 of the latching shaft actuators 80 against the tabs 82 on the latching shaft 54, thereby rotating the latching shaft 54 counterclockwise against the biasing pressure of the spring 66. This rotation of the latching shaft 54 causes both latching members 64 to disengage from both latching shackles 52, thereby unlatching both lids 32 from within. However, the lid 32 on the side of the truck mounted actuating assembly 16 is locked by means of the engaging arm 44 of the locking member 42 while the lid 32 on the opposite side has been unlatched and is not locked by means of its locking member 42.

As the operator of the truck 18 operates the fork lift assembly 104 to elevate and pivot the forks 106, the refuse container 10 inverts, and gravity causes the unlatched and unlocked lid 32 to open and discharge the contents of its compartment 30 into the refuse compartment 100 of the truck 18, thereby facilitating selective discharge and separation of the contents of the container 10.

Subsequently, the same truck or another truck with the actuating member 115 on the opposite side of the transverse bar 122 may repeat the process, but unlatches and locks the opposite lids 32. When the container 10 is now hoisted and tipped, the other compartment 30 is discharged into the truck.

As mentioned, in the normal condition of the preferred embodiment, the lids 32 are latched by the interior latching mechanism. To override the latching mechanism in order to place refuse into the container 10, the latching assembly for each lid 32 may be released by use of the key 94.

Figure 14:
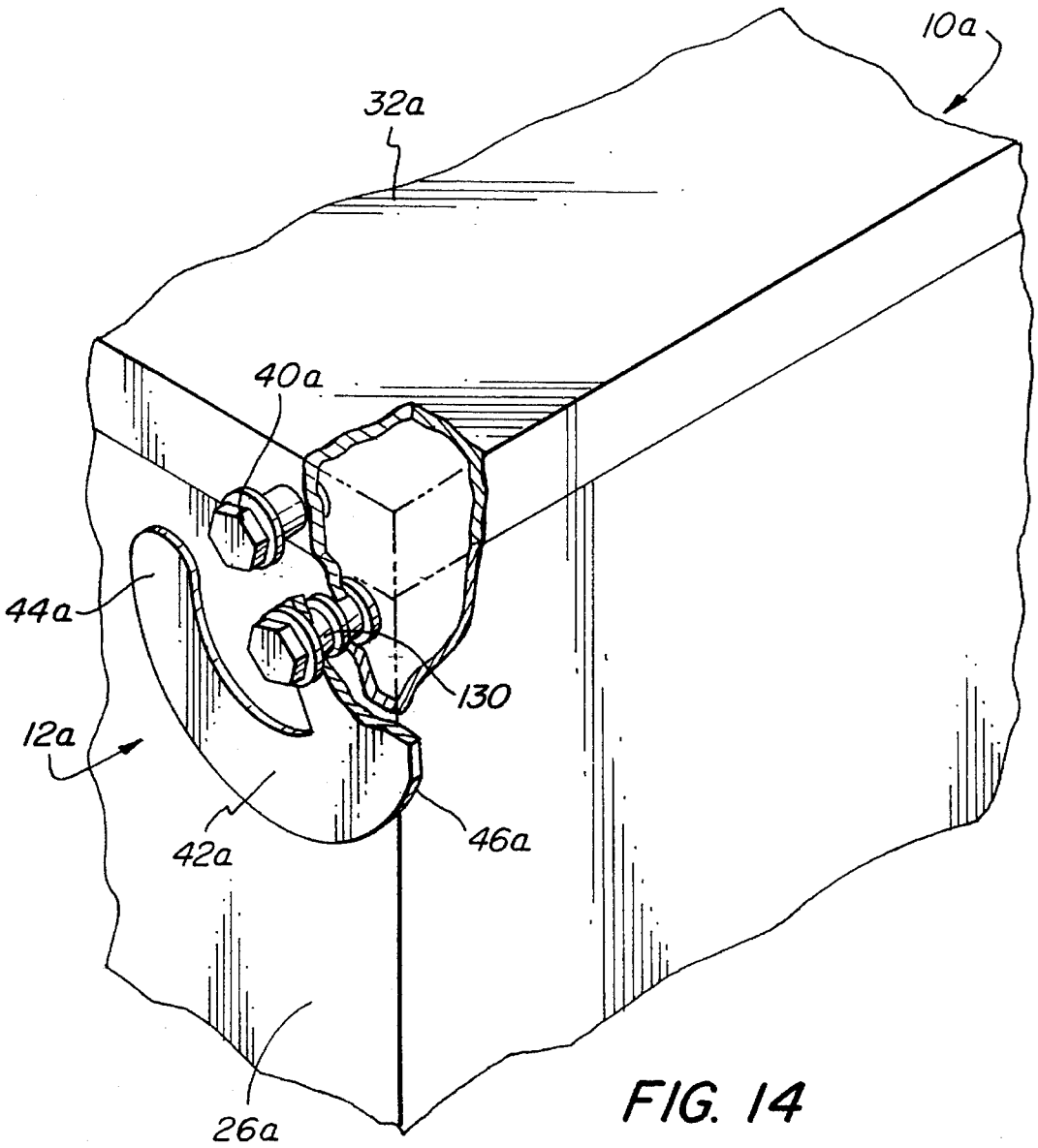
FIG. 14 is a fragmentary perspective view of another embodiment of the refuse container of the invention with part of the lid, front wall and side wall broken away.

Referring to FIG. 14, there is shown a fragmentary portion of an alternate embodiment of the refuse container for segregating refuse into two separate volumes. This embodiment is not provided with the internal latching assembly 14. The locking member 42*a* is pivotally mounted on a bolt 130 fastened to the side wall 26*a* of the refuse container 10*a*. In its normal state, gravity maintains the locking member 42*a* in the position shown so that the engaging arm 44*a* is spaced from the lock pin 40*a*.

In operation, the refuse collection truck operates the refuse container 10*a* in a manner identical to the preferred embodiment. The locking member 42*a* is engaged by the truck mounted actuating assembly (not shown) and rotated in a manner identical to the preferred embodiment to lock one lid 32*a*.

Various modifications of the illustrated embodiments may be made. For example, the locking member may slide between portions as a result of the force applied by the truck. A pair of sleeves may be employed in the latching assembly each with a key actuator to enable unlatching only one lid at a time by use of the key.

Thus, it can be seen from the foregoing specification and attached drawings that the refuse container assembly of the present invention readily segregates refuse into two volumes for separate collection. It is simple in design and can be fabricated by modifying existing refuse containers. Moreover, it can be operated with a high degree of reliability and does not require precise positioning of the refuse container over the truck.

Having thus described the invention, what is claimed is:

1. A refuse container assembly for segregating and discharging refuse in two separate volumes, comprising:

(a) a refuse container having front, rear, bottom and side walls, a divider wall extending therewithin from the front to rear walls to divide the interior of said container into two compartments, and separate lids extending over said compartments, each of said lids being hingedly connected to said rear wall and having an engageable element thereon extending outwardly of the adjacent side wall;

(b) a locking member on the outer surface of each of said side walls and having a portion configured to engage with said engageable element on said lids;

(c) means movably supporting said locking members for movement along said outer surface of said side walls between a first position disengaged from said engageable element and a second position wherein said engageable element is engaged thereby to lock said lids in a closed position, both of said locking members being normally in one of said first position; and (d) an actuating element for attachment to the fork assembly at the forward end of an associated refuse collection truck, said actuating element being cooperatively configured to move one of said locking members from said first position to said second position to lock said lid with the engageable element which is engaged, thereby allowing only the other of said lids to be opened to effect discharge of the contents of its compartment.

2. The refuse container assembly in accordance with claim 1 wherein said engageable element is a lock pin extending from said lid and beyond said side wall.

3. The refuse container assembly in accordance with claim 1 wherein said movably supporting means is provided by a pivot element on each side wall, said locking member being rotatable about a pivot axis defined by said pivot element in a plane substantially parallel to said side wall.

4. The refuse container assembly in accordance with claim 3 wherein said configuration of said locking member provides on one side an arm for engaging said lock pin, said arm being spaced from said pivot element, and said configuration also provides an arcuate surface portion along its side spaced to the side of said pivot element opposite from that having said arm, said locking member configuration producing rotation of the locking member from one of said positions to the other of said positions upon application of force to said arcuate surface.

5. The refuse container assembly in accordance with claim 1 including a latching assembly within said container, said latching assembly having latching means movable from first to second positions, said latching means being engageable with said lids in said first position to releasably latch said lids in a closed position, and means biasing said latching means towards said first position.

6. The refuse container assembly in accordance with claim 5 wherein said latching assembly is operatively coupled to said locking members whereby the application of force effecting movement of one of said locking members from said first position to said second position causes said latching means to move to the second position thereof wherein the lids are unlatched therefrom and only the lid engaged by said locking member is held against opening.

7. The refuse container assembly in accordance with claim 6 wherein said latching assembly includes a latching shackle on the inside surface of each of said lids adjacent the front end thereof, a latching shaft rotatable about a horizontal axis, and a pair of latching members on said shaft engaging said shackles upon rotation of said shaft, said biasing means acting upon said latching shaft to effect rotation of said latching members to said first position of said latching means.

8. The refuse container assembly in accordance with claim 7 wherein said movably supporting means for said locking members comprises a shaft coupled to said latching shaft and having end portions mounting said locking members for rotation therewith.

9. The refuse container assembly in accordance with claim 7 wherein said latching shaft is a sleeve on and rotatable about a shaft extending through said side walls to provide said movably supporting means for said locking members, and there is included a coupling between said sleeve and said shaft to effect rotation of said sleeve to unlatch said lids upon the application of force to effect movement of one of said locking members from said first position to said second position.

10. The refuse container assembly in accordance with claim 7 wherein one of the walls of said container is formed with an aperture and wherein said latching assembly includes a key aperture on said latching shaft aligned with said aperture, and a key insertable through said keyway to engage said key actuator for rotation of said latching shaft to a second position wherein said lids are unlatched.

11. A refuse container assembly for segregating and discharging refuse in two separate volumes, comprising:

(a) a refuse container having front, rear, bottom and side walls, a divider wall extending therewithin from the front to rear walls to divide the interior of said container into two compartments, and separate lids extending over said compartments, each of said lids being hingedly connected to said rear wall and having a lock pin thereon extending from said lid outwardly of the adjacent side wall;

(b) a latching assembly within said container having portions thereof extending outwardly through said side walls, said latching assembly being engageable with said lids to latch them in closed position;

(c) a locking member on the outer surface of each of said side walls and mounted on said outwardly extending portions of said latching assembly, said locking members being rotatable in a plane substantially parallel to said side wall between a first position disengaged from said lock pin and a second position wherein said lock pin is engaged thereby to lock the lid in a closed position, said locking member having on one side an arm for engaging said lock pin, said arm being spaced from the axis of rotation of said locking member, said configuration providing an arcuate surface portion along its side spaced to the side of said axis of rotation opposite from that having said arm, thereby allowing rotation of the locking member from one of said positions to the other of said positions upon application of force to said arcuate surface, said rotation of said locking member effecting release of said latching assembly; and (d) an actuating element for attachment to the forward end of an associated refuse collection truck, said actuating element being cooperatively configured to move one of said locking members from one of said positions to the other of said positions, thereby allowing one of said lids to be opened to effect discharge of the contents of its compartment.

12. The refuse container assembly in accordance with claim 11 wherein said latching assembly includes latching means movable from first to second positions, said latching means being engageable with said lids in said first position to releasably latch said lids in a closed position, and further includes means biasing said latching means towards said first position.

13. The refuse container assembly in accordance with claim 12 wherein said latching assembly is operatively coupled to said locking members whereby the application of force effecting movement of one of said locking members from said first position to said second position causes said latching means to move to the second position thereof wherein the lids are unlatched therefrom and only the lid engaged by said locking member is held against opening.

14. The refuse container assembly in accordance with claim 13 wherein said latching assembly includes a latching shackle on the inside surface of each of said lids adjacent the front end thereof, a latching shaft rotatable about a horizontal axis, and a pair of latching members on said shaft engaging said shackles upon rotation of said shaft, said biasing means acting upon said latching shaft to effect rotation of said latching members to said first position of said latching means.

15. The refuse container assembly in accordance with claim 14 wherein said outwardly extending portions of said latching assembly comprise shafts coupled to said latching shaft and upon which said locking members rotate.

16. The refuse container assembly in accordance with claim 14 wherein said latching shaft is a sleeve on and rotatable about a shaft extending through said side walls to provide said movably supporting means for said locking members, and there is included a coupling between said sleeve and said shaft to effect rotation of said sleeve to unlatch said lids upon the application of force to effect movement of one of said locking members from said first position to said second position.

17. The refuse container assembly in accordance with claim 14 wherein one of the walls of said container is formed with a aperture and wherein said latching assembly includes a key aperture on said latching shaft, and a key insertable through said keyway to engage said key actuator for rotation of said latching shaft to a second position wherein said lids are unlatched.

18. A refuse container assembly for segregating and discharging refuse in two separate volumes, comprising:

(a) a refuse container having front, rear, bottom and side walls, a divider wall extending therewithin from the front to rear walls to divide the interior of said container into two compartments, and separate lids extending over said compartments, each of said lids being hingedly connected to said rear wall and having a lock pin thereon extending from said lid outwardly of the adjacent side wall;

(b) a locking member on the outer surface of each of said side walls and having an arm engageable with said lock pin and a cam surface spaced from said arm;

(c) a pivot element on each side wall mounting said locking member thereon and enabling said locking member to rotate about pivot axis defined by said pivot element along the outer surface of said side wall in a plane substantially parallel to said side wall and between a first position disengaged from said lock pin and a second position wherein said lock pin is engaged thereby to lock said lids in a closed position, both of said locking members being normally in said first position; and (d) an actuating element for attachment to the fork assembly at the forward end of an associated refuse collection truck, said actuating element being cooperatively configured to abut said cam surface of one of said locking members to effect its movement from said first position to said second position to lock said lid with the engageable element which is engaged, thereby allowing only the other of said lids to be opened to effect discharge of the contents of its compartment.

19. The refuse container assembly in accordance with claim 18 wherein said configuration of said locking member provides on one side an arm for engaging said lock pin, said arm being spaced from said pivot surface, and said configuration also provides an arcuate surface portion along its side spaced to the side of said pivot surface opposite from that having said arm, said locking member configuration producing rotation of the locking member from one of said positions to the other of said positions upon application of force to said arcuate surface.

20. A refuse container assembly for segregating and discharging refuse in two separate volumes, comprising:

(a) a refuse container having front, rear, bottom and side walls, a divider wall extending therewithin from the front to rear walls to divide the interior of said container into two compartments, and separate lids extending over said compartments, each of said lids being hingedly connected to said rear wall and having an engageable element thereon extending outwardly of the adjacent side wall;

(b) a locking member on the outer surface of each of said side walls and each having a portion configured to engage with said engageable element on said lids;

(c) means movably supporting said locking members for movement along said outer surface of said side walls between a first position disengaged from said engageable element and a second position wherein said engageable element is engaged thereby to lock said lids in a closed position, both of said locking members being normally in said first positions;

(d) an actuating element for attachment to the fork assembly at the forward end of an associated refuse collection truck, said actuating element being cooperatively configured to move one of said locking members from said first position to said second position to lock said lid with the engageable element which is engaged, thereby allowing only the other of said lids to be opened to effect discharge of the contents of its compartment; and (e) a latching assembly within said container, said latching assembly having a latching shaft and latching means movable from first to second positions, said latching means being engageable with said lids in said first position to releasably latch said lids in a closed position, and means biasing said latching means towards said first position, said movable supporting means for said locking members comprises a shaft coupled to said latching shaft and having end portions mounting said locking members for rotation therewith, said latching assembly being operatively coupled to said locking members whereby the application of force effecting movement of one of said locking members from said first position to said second position causes said latching means to move to the second position thereof wherein the lids are unlatched therefrom and only the lid engaged by said locking member is held against opening.

* * * * *